US009927166B2

(12) United States Patent
Faehnle et al.

(10) Patent No.: US 9,927,166 B2
(45) **Date of Patent: *Mar. 27, 2018**

(54) REFRIGERATION APPLIANCE COMPRISING A WATER CIRCUIT

(71) Applicant: BSH HAUSGERAETE GMBH, Munich (DE)

(72) Inventors: Elmar Faehnle, Elchingen (DE); Eugen Gaplikow, Bubesheim (DE); Hans Gerd Keller, Giengen (DE); Michael Krapp, Nattheim (DE); Karl-Friedrich Laible, Langenau (DE); Vitaliy Rimkevich, Giengen (DE); Hans Peter Werner, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 122 days.

This patent is subject to a terminal disclaimer.

(21) Appl. No.: 14/888,161

(22) PCT Filed: Apr. 16, 2014

(86) PCT No.: PCT/EP2014/057740

§ 371 (c)(1),
(2) Date: Oct. 30, 2015

(87) PCT Pub. No.: WO2014/177382

PCT Pub. Date: Nov. 6, 2014

(65) Prior Publication Data

US 2016/0054048 A1 Feb. 25, 2016

(30) Foreign Application Priority Data

Apr. 30, 2013 (DE) ..... 10 2013 207 953

(51) Int. Cl.
*F25D 21/14* (2006.01)
*F25D 23/12* (2006.01)
(Continued)

(52) U.S. Cl.
CPC ..... *F25D 21/14* (2013.01); *F25D 23/126* (2013.01); *F25C 1/225* (2013.01); *F25C 5/005* (2013.01);
(Continued)

(58) Field of Classification Search
CPC ..... F25D 21/14; F25D 23/126; F25C 1/225; F25C 5/005; F25C 2400/14
See application file for complete search history.

(56) References Cited

U.S. PATENT DOCUMENTS 3,012,417 A 12/1961 Harle
4,020,644 A 5/1977 True, Jr. et al.
(Continued)

FOREIGN PATENT DOCUMENTS

CN 101738049 A 6/2010
CN 102466386 A 5/2012
(Continued)

*Primary Examiner* — Frantz Jules
*Assistant Examiner* — Martha Tadesse
(74) *Attorney, Agent, or Firm* — Laurence A. Greenberg; Werner H. Stemer; Ralph E. Locher

(57) ABSTRACT

A refrigeration appliance includes a water pipe inside the refrigeration appliance. A collecting tray collects leakage water and an empty conduit conducts the leakage water from the water pipe inside the empty conduit to the collecting tray.

14 Claims, 3 Drawing Sheets

(51) Int. Cl.
*F25C 1/22* (2018.01)
*F25C 5/00* (2018.01)

(52) U.S. Cl.
CPC ..... *F25C 2400/14* (2013.01); *F25C 2500/06* (2013.01)

(56) References Cited

U.S. PATENT DOCUMENTS 4,877,049 A * 10/1989 Fornasari ..... D06F 39/081 137/312
5,782,263 A * 7/1998 Isaacson, Jr. ..... F16K 17/20 137/459
8,776,827 B2 * 7/2014 Mao ..... E03B 7/071 137/460
9,284,174 B2 * 3/2016 Springer ..... A47G 19/2255
9,303,782 B2 * 4/2016 Stoltz ..... E03D 11/00
9,410,636 B2 * 8/2016 Older ..... F16K 21/16
9,440,835 B2 * 9/2016 Springer ..... A47G 19/2205
2001/0003286 A1 * 6/2001 Philippbar ..... G01M 3/243 137/624.12
2002/0040941 A1 * 4/2002 Wiemer ..... A47L 15/4217 239/226
2008/0168791 A1 * 7/2008 Nebbia ..... F25D 21/14 62/389
2011/0036436 A1 * 2/2011 Haltmayer ..... A47L 15/4217 137/872
2011/0048549 A1 * 3/2011 Gwan-Ho ..... A47L 15/421 137/382

FOREIGN PATENT DOCUMENTS

DE 102006002445 A1 7/2007
DE 112006000552 T5 3/2008
EP 1624266 A1 2/2006
EP 2357435 A2 11/2009
EP 2357435 A2 * 8/2011 ..... F25D 23/068
GB 2181748 A * 4/1987 ..... D06F 39/081

* cited by examiner

REFRIGERATION APPLIANCE COMPRISING A WATER CIRCUIT

BACKGROUND OF THE INVENTION

Field of the Invention

The present invention relates to a refrigeration appliance comprising a water circuit inside the refrigeration appliance.

The publication DE 11 2006 000 552 T5 describes a cooling apparatus comprising a liquid supply system for a user apparatus with a protection system in order to prevent an overflow arising from a potential leakage of liquid.

BRIEF SUMMARY OF THE INVENTION

It is the object of the invention to provide a refrigeration appliance comprising water-conducting components in which the refrigeration appliance and the surroundings thereof are substantially protected from the possible consequences of a water leakage.

This object is achieved by the subject having the features as claimed in the independent claim. Advantageous embodiments of the invention form the subject-matter of the figures, the description and the dependent claims.

According to one feature of the invention, the object is achieved by a refrigeration appliance having a water pipe inside the refrigeration appliance, in which the refrigeration appliance comprises a collecting tray for collecting the leakage water and an empty conduit for conducting the leakage water from the water pipe inside the empty conduit to the collecting tray. As a result, for example, the technical advantage is achieved that leakage water is able to be discharged from a hose via the empty conduits to the hose guide.

A "refrigeration appliance" is understood, in particular, as a domestic refrigeration appliance, i.e. a refrigeration appliance which is used for household management in the home or in the catering field and, in particular, serves to store food and/or beverages at specific temperatures, such as for example a refrigerator, an upright freezer, a combined fridge-freezer, a chest freezer or a wine cooler.

In one advantageous embodiment of the refrigeration appliance, the collecting tray comprises an overflow for diverting leakage water to an evaporation tray. As a result, for example, the technical advantage is achieved that leakage water is able to be collected in an additional collection volume.

In a further advantageous embodiment of the refrigeration appliance, the empty conduit is incorporated by foam in a wall of the refrigeration appliance. As a result, for example, the technical advantage is achieved that, even in the case of a leakage of the empty conduit, water is prevented from directly escaping.

In a further advantageous embodiment of the refrigeration appliance, the collecting tray is arranged in a valve housing comprising a function valve for the controlled dispensing of water. As a result, for example, the technical advantage is achieved that leakage water which escapes from a function valve may be additionally collected.

In a further advantageous embodiment of the refrigeration appliance, the evaporation tray is arranged below the valve housing. As a result, for example, the technical advantage is achieved that a compact valve housing may be produced.

In a further advantageous embodiment of the refrigeration appliance, the evaporation tray is arranged in thermal contact with a compressor. As a result, for example, the technical advantage is achieved that an evaporation of collected water from the evaporation tray is increased.

In a further advantageous embodiment of the refrigeration appliance, the valve housing comprises a connection for an empty conduit. As a result, for example, the technical advantage is achieved that the empty conduit may be positioned on the valve housing and leakage water is directly conducted into the inside of the valve housing.

In a further advantageous embodiment of the refrigeration appliance, the valve housing comprises a connection for an inlet hose from a water supply connection of the refrigeration appliance, said inlet hose comprising an outer hose and an inner hose. As a result, for example, the technical advantage is achieved that leakage water is directly conducted from the inner hose of the inlet hose into the inside of the valve housing.

In a further advantageous embodiment of the refrigeration appliance, the refrigeration appliance comprises a safety valve for shutting off the water supply connection. As a result, for example, the technical advantage is achieved that a water circuit may be depressurized inside the refrigeration appliance.

In a further advantageous embodiment of the refrigeration appliance, the collecting tray is integrated in the valve housing. As a result, for example, the technical advantage is achieved that the design of the refrigeration appliance is simplified.

In a further advantageous embodiment of the refrigeration appliance, the valve housing comprises a leakage detection device for detecting a leakage in the water circuit. As a result, for example, the technical advantage is achieved that suitable measures may be carried out automatically in the event of a detected leakage.

In a further advantageous embodiment of the refrigeration appliance, the leakage detection device comprises a microswitch for interrupting a power supply in the event of a detected leakage. As a result, for example, the technical advantage is achieved that a short circuit is prevented in the event of escaping water.

In a further advantageous embodiment of the refrigeration appliance, the leakage detection device comprises a float for actuating the microswitch. As a result, for example, the technical advantage is achieved that a leakage water level may be detected in a simple manner.

In a further advantageous embodiment of the refrigeration appliance, the valve housing comprises a non-return valve between the connection for an inlet hose and the function valve. As a result, for example, the technical advantage is achieved that an inadvertent escape of water from the refrigeration appliance is prevented.

In a further advantageous embodiment of the refrigeration appliance, the evaporation tray is formed from a thermally conductive material. As a result, for example, the technical advantage is achieved that the evaporation of the water from the evaporation tray is increased.

BRIEF DESCRIPTION OF THE SEVERAL VIEWS OF THE DRAWING

Exemplary embodiments of the invention are shown in the drawings and are described hereinafter in more detail.

In the drawings.

DESCRIPTION OF THE INVENTION

Figure 1:
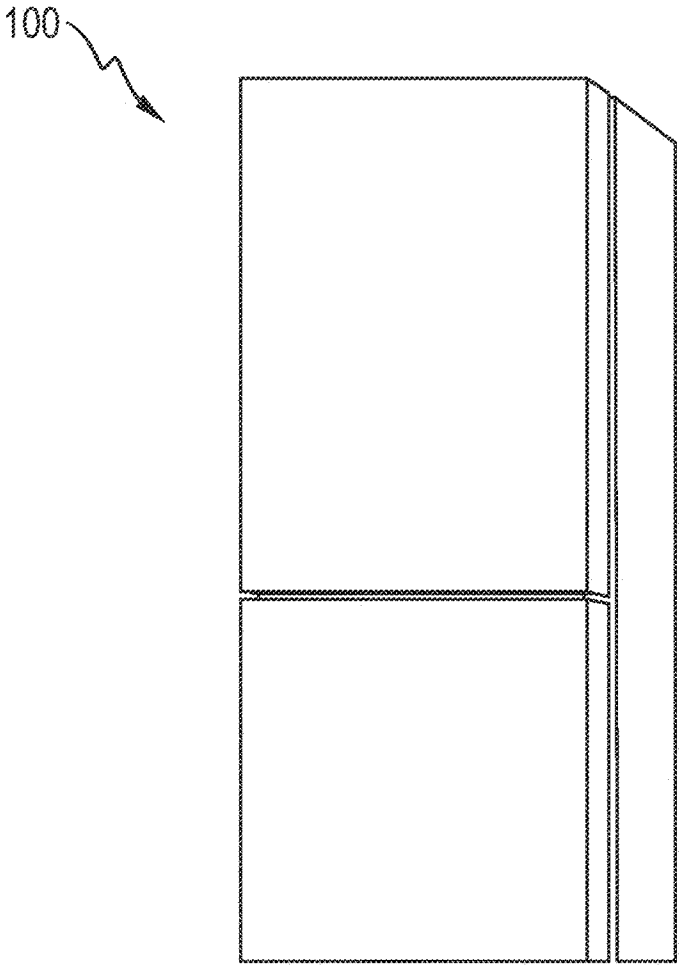
FIG. 1 shows a schematic view of a refrigeration appliance.

FIG. 1 shows a refrigerator representing a general refrigeration appliance 100. The refrigerator serves, for example, for cooling food and comprises a refrigerant circuit comprising an evaporator, a compressor, a condenser and a throttle member. The evaporator is a heat exchanger in which after expansion the liquid refrigerant is evaporated by means of heat absorption by the medium to be cooled, i.e. the air inside the refrigerator.

The compressor is a mechanically operated component which draws in refrigerant vapor from the evaporator and discharges it at a higher pressure to the condenser. The condenser is a heat exchanger in which after compression the evaporated refrigerant is condensed by means of heat dissipation to an external cooling medium, i.e. the ambient air. The throttle member is a device for continuously reducing the pressure by narrowing the cross section.

The refrigerant is a fluid which is used for the transmission of heat in the cold-generating system and which absorbs heat at low temperatures and low pressure of the fluid and discharges heat at a higher temperature and higher pressure of the fluid, wherein changes in the state of the fluid are generally included.

Figure 2:
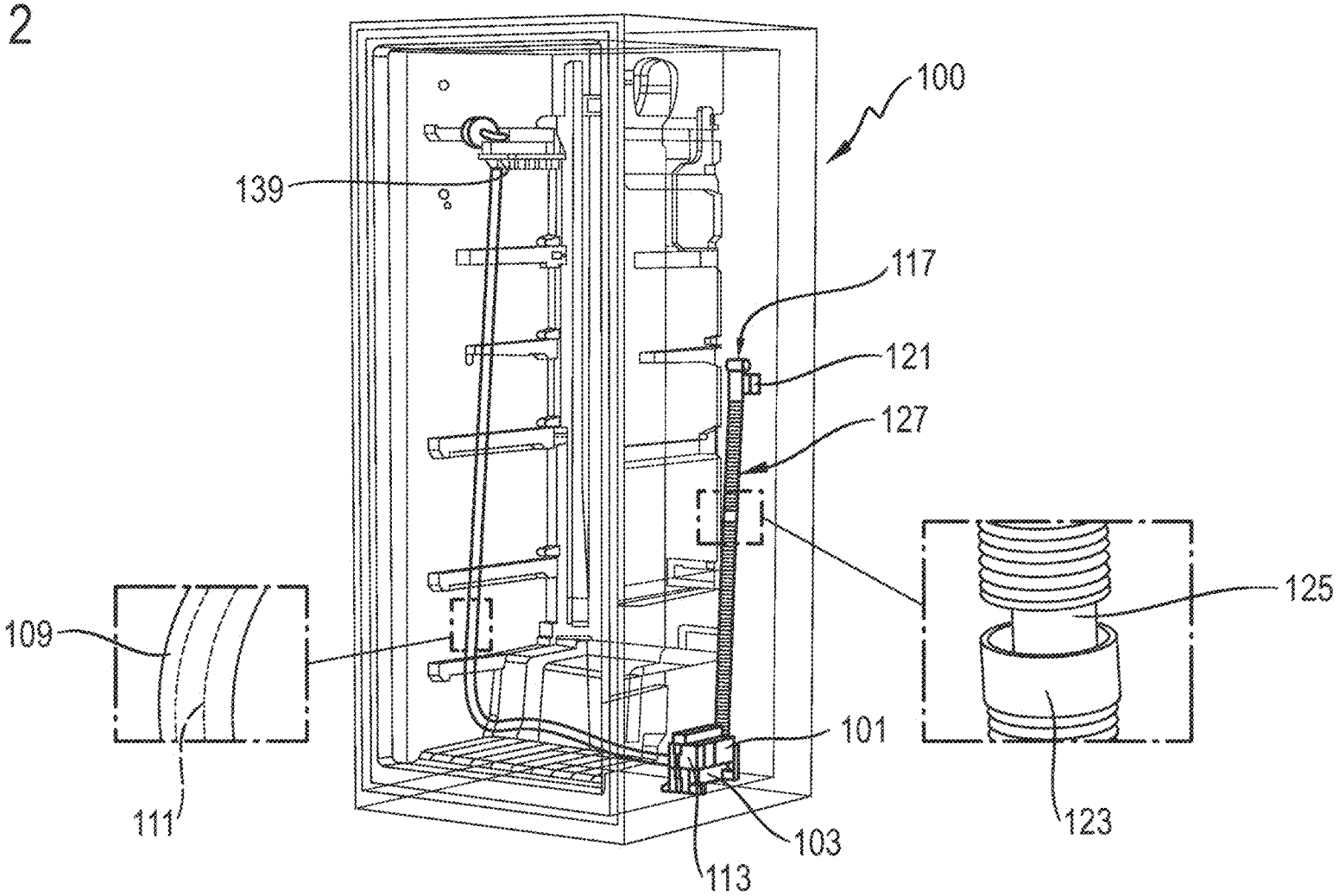
FIG. 2 shows a refrigeration appliance comprising a water supply line.

FIG. 2 shows a water supply line in the refrigeration appliance 100 viewed from the front of the appliance. The refrigeration appliance 100 is connected to an external water supply and is provided with an automatic ice and/or water dispenser with corresponding water-conducting components. The refrigeration appliance 100 is connected to an external water supply connection 117 by an inlet hose 127, which forms an inlet line from the water supply connection 117. The inlet hose 127 comprises an electrical safety valve 121 which is directly arranged on the water supply connection 117 and is controlled by the refrigeration appliance 100. The safety valve 121 is located at the start of the inlet hose 127.

The safety valve 121 serves as a water valve in the water circuit of the refrigeration appliance 100 and shuts off the line pressure at the external water supply connection 117, so that the subsequent water circuit inside the refrigeration appliance 100 is depressurized.

The inlet hose 127 comprises an inner hose 125 which conducts the water from the water supply connection 117 to the refrigeration appliance 100 and an outer hose 123 which surrounds the inner hose 125 and conducts any potential leakage water from the inner hose 125 or the safety valve 121 and the joints thereof to a collecting tray 103. The inlet hose 127 is connected to a valve housing 113 which is arranged inside the refrigeration appliance 100 and comprises a leakage detection device 101. A water pipe 111 leads from the function valve and the valve housing 113 to an automatic ice maker 139 and/or to a further water dispenser.

The collecting tray 103 for the leakage water is integrated in the valve housing 113. The valve housing 113 serves at the same time as a receiver housing for a function valve and for the components which are responsible for the leakage detection. Leakage points inside the refrigeration appliance 100 may occur, in particular, at joints or connection points of different water-conducting components.

The resilient water pipe 111 is guided through an empty conduit 109 to the hose guide which is installed in the insulating foam of the refrigeration appliance 100. The empty conduit 109 serves for the ease of hose installation. Moreover, the empty conduit 109 serves for removing the leakage water which may be produced in the path of the water pipe 111 and the joints thereof to further components. To this end, the empty conduits 109 are connected to the valve housing 113 such that leakage water is fed into the collecting tray 103 inside the valve housing 113. In particular, the joints and transitions in different water-conducting components may be protected from the escape of water by the surrounding empty conduits 109.

Figure 3:
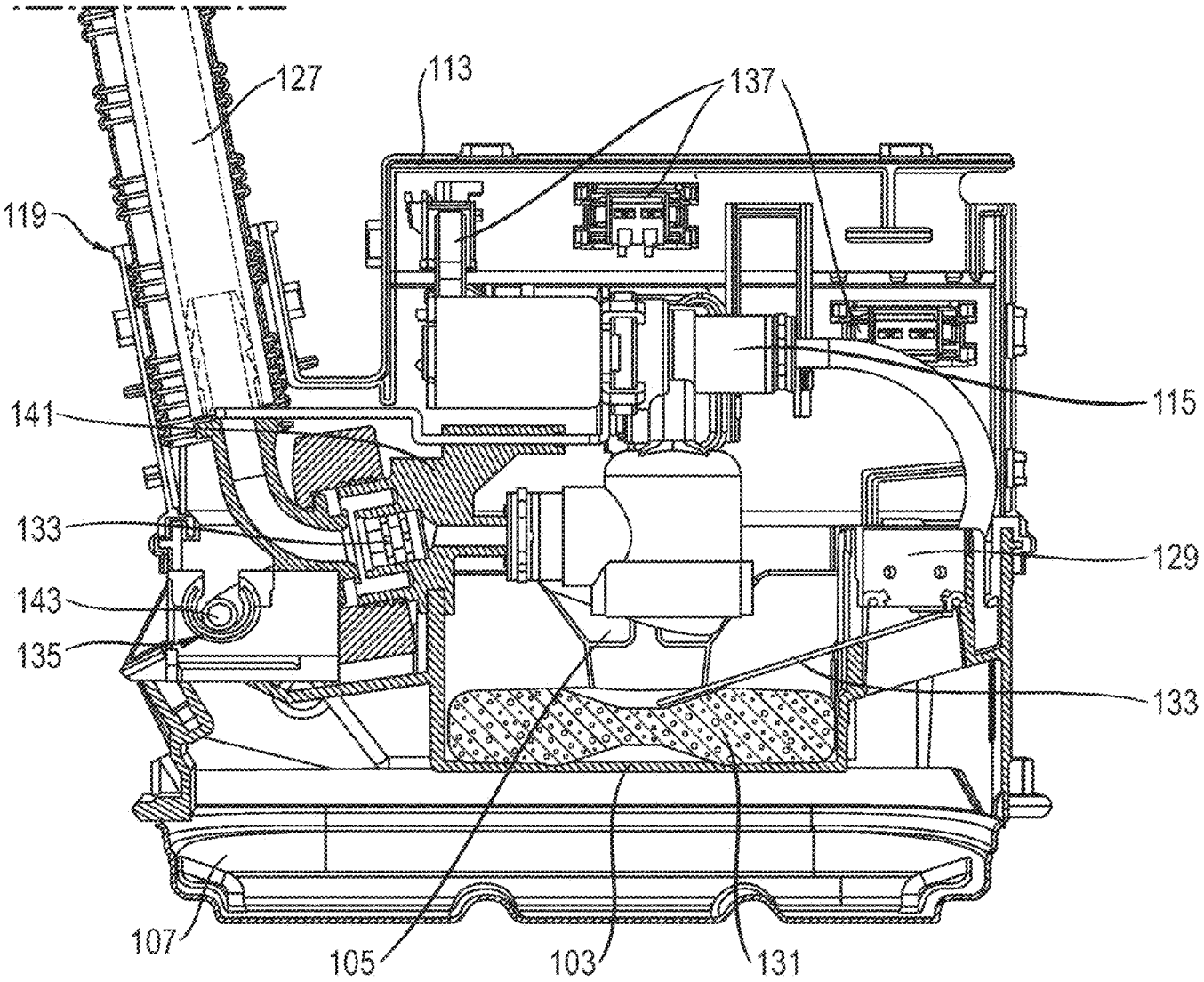
FIG. 3 shows the construction of a valve housing and further functional components.

FIG. 3 shows a construction of the valve housing 113 and further functional components. The refrigeration appliance 100 comprises the safety valve 121 at the water supply connection 117 and the function valve 115 inside the refrigeration appliance 100. The function valve 115 permits a controlled flow of water for dispensing water from the water circuit. The safety valve 115 is a valve without a flow control device for fully opening or shutting off the water supply.

The safety valve 121 and the function valve 115 are connected in series. The function valve 115 is arranged in the direction of the flow of water in the water circuit, downstream of the safety valve 121. Even if one of the two valves should no longer be able to close off a water supply due to a malfunction, in this case the water supply may be closed off by the other of the two valves. Even with a temporary dripping valve, therefore, the water supply may be fully closed off.

Both the safety valve 121 and the function valve 115 may be electrically switched by a control device. Both a simultaneous and time-delayed activation and deactivation of the valves is possible by means of the electronic control of the valves.

The water-conducting components and the water supply connections thereof are arranged in the valve housing 113 such that any leakage water which may be produced is collected in the collecting tray 103. The collecting tray 103 has an overflow 105 for collected leakage water. The overflow 105 firstly serves for protecting the electrical components from increasing leakage water and secondly serves for removing the excess leakage water.

In order to collect this excess leakage water, the collecting tray 103 is arranged above an evaporation tray 107. The actual purpose of the evaporation tray 107 is to collect defrosting water from the refrigeration appliance 100. By the arrangement of the collecting tray 103 above the evaporation tray 107, an additional collection volume for the leakage water is produced so that the design of the valve housing 113 itself is able to be as compact as possible.

The leakage water is conducted to the collecting tray 103 as part of the leakage detection device 101. A float 131 which floats as a result of the increasing leakage water and actuates a microswitch 129 via a switch lever 133 is arranged here. The collecting tray 103 inside the valve housing 113 has a small collection volume for leakage water. Only a small volume of water is required, therefore, for actuating the microswitch 129 by means of the float 131 in the case of a leakage. As a result, the advantage is achieved that a leakage may be reliably detected even with small quantities of escaping water. If more water flows out of the leakage, this is conducted in a controlled manner via the overflow 105 to the evaporation tray 107 which has a larger collection volume. The collecting tray 103 is arranged above the evaporation tray 107 so that water flows from the overflow 105 into the evaporation tray 107 due to gravitational force. To this end, the overflow 105 may be connected to the evaporation tray 107 by means of a hose.

As a result, both a detection of the leakage by small quantities of leakage water [is possible] and an escape of the leakage water is prevented. Additionally due to the small collection volume of the collecting tray 103 the valve housing 117 may be produced in a compact design.

The microswitch 129 is thus incorporated in the electrical circuit of the safety valve 121 such that it interrupts the power supply to the safety valve 121. The power supply is provided, for example, by a mains power supply. As a result, it is ensured that in the case of a leakage the safety valve 121 is mechanically separated from the power supply. Power cables and the cable connectors inside the refrigeration appliance 100 are arranged spatially such that they are not able to come into contact with water. To this end, water-conducting components and possible leakage points are arranged below the electrical power cables and plugs.

As a result, the safety valve 121 is closed in the event of a leakage and the water flow to the refrigeration appliance 100 is interrupted at the connection point to the water supply. The actuated microswitch 129 emits a signal to a control device so that a power supply to the function valve 115 is also interrupted via the control device. When the power supply is interrupted, both the function valve 115 and the safety valve 121 are in the closed state. If the power supply is interrupted, the valves accordingly close automatically. The direct interruption of the power supply provides the most secure form of mechanical deactivation. If a water leakage is detected by the leakage detection device 101 by the microswitch 129, a visible or audible alarm is emitted at the control panel of the refrigeration appliance 100.

Additionally, a non-return valve 133 is installed between the safety valve 121 and the function valve 115 in the valve housing 113. The non-return valve 133 prevents an uncontrolled outflow of water from the water circuit of the refrigeration appliance, for example if the refrigeration appliance 100 is disconnected from an external water supply during dismantling. In addition, the non-return valve 133 prevents the water located in the refrigeration appliance 100 from flowing back into the domestic water supply. This may be achieved in a particularly reliable and space-saving manner by the use of the non-return valve 133 inside the water circuit. Unlike other domestic appliances, such as for example dishwashers, which use a free-flowing path, it is possible to use the non-return valve 133 in the water circuit of the refrigeration appliance 100 without any difficulty, as the water in the water circuit of the refrigeration appliance 100 does not contain any residual dirt and has a high water quality.

The water pipes 111 are installed in the refrigeration appliance 100 via the empty conduits 109 in which hoses are guided. These empty conduits 109 are used for conducting the leakage water from the water-conducting components to the collecting tray 103. To this end, the valve housing 113 has an empty conduit connection 135 with a hose outlet 143. The inlet hose 127 from the safety valve 121 is connected to the valve housing 113 at a connection 119 with a hose inlet.

The collecting tray 103 comprises the overflow 105 which is directly located above an evaporation tray 107. The function valve 115 is mechanically coupled via a connection point 141 to the non-return valve 133. Additionally, the valve housing 113 comprises a plurality of plug connections 137 for supplying the leakage detection device with electrical power. The plug connections 137 serve for supplying electrical power or for transmitting control signals. A first plug connection 137 is provided, for example, for supplying power to the function valve 115, a second plug connection 137 is provided, for example, for transmitting electrical signals from the microswitch 129 and a third plug connection 137 is provided for connecting a control line for the safety valve 121.

In further embodiments, the non-return valve 133 may be positioned between the safety valve 121 and the water supply connection 117. The inlet hose 127 may be connected directly to the safety valve 121 without a connecting piece. The function valve 115 may be integrated in the inlet hose 127 immediately downstream of the safety valve 121.

The described system may be used in all refrigeration appliances such as, for example, refrigerators, freezers or combined appliances. By means of the system it is possible for damage due to leakage water from water-conducting components and the joints thereof to be prevented. A direct arrangement of the safety valve 121 at the water supply connection 117 permits a depressurized water system inside the refrigeration appliance 100 if no water is required by the refrigeration appliance 100. The functional reliability of the water circuit is increased by combining the safety valve 121 and the function valve 115. The empty conduits 109 in the insulating foam of the refrigeration appliance 100 serve not only for guiding water pipes and hoses but also for removing leakage water. The safety valve 121 and/or the function valve 115 may be formed by a solenoid valve.

The valve housing 113 may be produced in a compact manner by means of the overflow 105 for leakage water from the collecting tray 103 into the evaporation tray 107. The evaporation tray 107 may form part of the valve housing 113. In addition, the evaporation tray 107 may be formed from a thermally conductive material such as metal or sheet metal, so that the transmission of heat to the evaporation tray 107 is improved and the defrosting is increased.

All of the features described and shown in connection with individual embodiments of the invention may be provided in different combinations in the subject-matter according to the invention, in order to produce the advantageous effects thereof simultaneously.

The scope of protection of the present invention is defined by the claims and is not limited by the features explained in the description or shown in the figures.

LIST OF REFERENCE NUMERALS

100 Refrigeration appliance
101 Leakage detection device
103 Collecting tray
105 Overflow
107 Evaporation tray
109 Empty conduit
111 Water pipe
113 Valve housing
115 Function valve
117 Water supply connection
119 Connection
121 Safety valve
123 Outer hose
125 Inner hose
127 Inlet hose/supply line
129 Microswitch
131 Float
133 Non-return valve
135 Empty conduit connection
137 Plug connection
139 Ice maker
141 Connecting part
143 Hose outlet

The invention claimed is:

1. A refrigeration appliance, comprising:

a water pipe inside the refrigeration appliance;

an evaporation tray;

a valve housing;

a collecting tray disposed in said valve housing for collecting leakage water, said collecting tray including an overflow for diverting the leakage water to said evaporation tray;

a function valve disposed in said valve housing for controllably dispensing water; and an empty conduit for conducting the leakage water from said water pipe inside said empty conduit to said collecting tray.

2. The refrigeration appliance according to claim 1, which further comprises a refrigeration appliance wall, and foam disposed in said wall, said empty conduit being incorporated by said foam in said wall.

3. The refrigeration appliance according to claim 1, wherein said evaporation tray is disposed below said valve housing.

4. The refrigeration appliance according to claim 1, which further comprises a compressor, said evaporation tray being disposed in thermal contact with said compressor.

5. The refrigeration appliance according to claim 1, wherein said valve housing includes a connector for said empty conduit.

6. The refrigeration appliance according to claim 1, which further comprises:

a water supply connection; and an inlet hose connected to said water supply connection, said inlet hose including an outer hose and an inner hose;

said valve housing having a connection for said inlet hose.

7. The refrigeration appliance according to claim 6, which further comprises a safety valve for shutting off said water supply connection.

8. The refrigeration appliance according to claim 1, wherein said collecting tray is integrated in said valve housing.

9. The refrigeration appliance according to claim 1, wherein said valve housing includes a leakage detection device for detecting leakage in a water circuit.

10. The refrigeration appliance according to claim 9, wherein said leakage detection device includes a micro switch for interrupting a power supply in an event of a detected leak.

11. The refrigeration appliance according to claim 10, wherein said leakage detection device includes a float for actuating said micro switch.

12. The refrigeration appliance according to claim 6, wherein said valve housing includes a non-return valve disposed between said connection for said inlet hose and said function valve.

13. The refrigeration appliance according to claim 1, wherein said evaporation tray is formed of a thermally conductive material.

14. The refrigeration appliance according to claim 1, wherein said water pipe is disposed inside said empty conduit.

* * * * *